US011517133B2

(12) United States Patent
Ramos

(10) Patent No.: US 11,517,133 B2
(45) Date of Patent: Dec. 6, 2022

(54) SHOE HOLDER

(71) Applicant: Ferdinand Ramos, San Pablo, CA (US)

(72) Inventor: Ferdinand Ramos, San Pablo, CA (US)

( * ) Notice: Subject to any disclaimer, the term of this patent is extended or adjusted under 35 U.S.C. 154(b) by 194 days.

(21) Appl. No.: 16/732,681

(22) Filed: Jan. 2, 2020

(65) Prior Publication Data

US 2021/0204736 A1 Jul. 8, 2021

(51) Int. Cl.

| | |
|---|---|
| ***A47G 25/00*** | (2006.01) |
| *A47F 7/08* | (2006.01) |
| *A47F 5/08* | (2006.01) |

(52) U.S. Cl.

CPC ..... *A47G 25/005* (2013.01); *A47F 5/08* (2013.01); *A47F 7/08* (2013.01)

(58) Field of Classification Search

CPC . A47G 25/005; A47F 5/08; A47F 7/08; A47L 23/20; A43D 117/00; A47B 61/04; B65D 85/187

USPC ..... 211/34, 35, 85, 89.01, 87.01, 106, 211/106.01, 113, 119

See application file for complete search history.

(56) References Cited

U.S. PATENT DOCUMENTS

| | | | | | |
|---|---|---|---|---|---|
| 1,987,154 | A * | 1/1935 | Noffsinger | A47K 10/22 | 242/900 |
| 2,180,598 | A * | 11/1939 | Mahan | H02G 3/123 | 220/3.5 |
| 2,879,012 | A * | 3/1959 | Sarro | A47K 10/38 | 242/596.7 |
| 2,937,762 | A * | 5/1960 | Deuter | A47G 25/06 | 211/106.01 |
| 3,282,519 | A * | 11/1966 | Rheinstrom | A47K 10/38 | 242/596.8 |
| D578,813 | S * | 10/2008 | Goodman | D6/522 | |
| 10,021,975 | B1 * | 7/2018 | Womble | A47B 96/021 | |
| 2007/0251894 | A1 * | 11/2007 | Kelley | A47F 7/08 | 211/34 |
| 2011/0240576 | A1 * | 10/2011 | Abbruzzese | A47F 10/02 | 211/85.3 |
| 2016/0265716 | A1 * | 9/2016 | White | A47F 5/0853 | |
| 2017/0133829 | A1 * | 5/2017 | Caporale | H01B 3/443 | |

* cited by examiner

*Primary Examiner* — Devin K Barnett
(74) *Attorney, Agent, or Firm* — Daniel M. Cohn; Howard M. Cohn

(57) ABSTRACT

An improved shoe holder designed as a shoe storage and display in a vertical disposition. The improved shoe holder includes a frame formed of an upright plate. First and second support arms are disposed on the upright plate. Finally, first and second footwear receiving elements are mounted respectively on the first and second support arms to receive and store the shoe.

5 Claims, 2 Drawing Sheets

SHOE HOLDER

TECHNICAL FIELD OF THE INVENTION

The present invention relates to an improved shoe holder, and more particularly to an improved shoe holder designed as a shoe storage and display in a vertical disposition.

BACKGROUND OF THE INVENTION

Various types of shoe racks have been developed in order to accommodate the organized storage of shoes. The shoe racks that have been used include both self-standing units that are supported on the floor and hanging units that hang on doors or other vertical surfaces. These methods for storing shoes are often designed around the physical restraints imposed by the shoe geometry, including width, height, and length. The different variations of shoe racks described in the prior art provide for a dizzying array of styles of shoe racks, each having a different look, a different way of holding or hanging the shoe, and a different method of addressing the physical requirements of the shoes.

Some shoe racks are mounted to a wall, some are hung over a door, and still others are provided to free stand, and all provide for a means to store shoes. It must be noted that pairs of shoes also may be stored in a shoe cabinet. The conventional shoe cabinet has a large storage space. Thus, the conventional shoe cabinet may occupy a large space of a room. Furthermore, internal space of the conventional shoe cabinet is divided into multiple tiers for storing shoes.

The primary problem with conventional shoe racks is their inability to have sufficient flexibility or interchangeability as the size and number of shoes required to be stored varies. This leads to excessive wasted space or worse yet, certain types of shoes that are not compatible with the shoe rack design. Some types of shoe racks include a surface or mounting on which the bottom of the shoes rest side-by-side in a down-ward, sloped position. Because the number of shoes placed side-by-side is limited by width of the shoes, any variation in shoe height provides for an overall under-utilization of space due to the excess space that exists above and below individual pairs of shoes.

For shoe racks that hold the shoes on an upside down "U" shaped holder or in pouches, such as are often mounted on the back of a door, the number of shoes which may be held is limited by the number of evenly spaced holders, and furthermore the ability to locate a pair of shoes is hindered by lack of visibility of the tops of the shoes. Other types of shoes racks include shelf, rack, pouch, and cubby systems, and each one has different limitations as to the size, shape, width, length or height of the shoes that it can accommodate. Other problems related to the prior art involve stability of the systems, and inability of the shoe racks to retain shoes in a secure fashion. For example, typical door-mounted styles of hanging shoe racks have a limitation such that when the door is opened, the shoe racks lack the lateral support necessary to keep the shoes from falling or sliding off.

SUMMARY OF THE INVENTION

According to an embodiment of the present invention, there is disclosed an improved shoe holder designed as a shoe storage and display in a vertical disposition. The improved shoe holder includes a frame formed of an upright plate. First and second support arms are disposed on the upright plate. Finally, first and second footwear receiving elements are mounted respectively on the first and second support arms to receive and store the shoe.

According to another embodiment of the present invention, there is disclosed an improved shoe holder designed as a shoe storage and display in a vertical disposition. The improved shoe holder includes a one piece, unitary member frame formed of an upright rectangular plate having top and bottom walls respectively, and first and second side walls. An opening is disposed through the plate to mount the improved shoe holder to a wall. Identical first and second support arms are disposed on the first and second side walls of the upright plate. The first support arm is formed of a first elongated element and a second elongated element, and the second support arm formed of a first elongated element and a second elongated element. The first and second footwear receiving elements are mounted respectively on the first and second support arms to receive and store the shoe.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
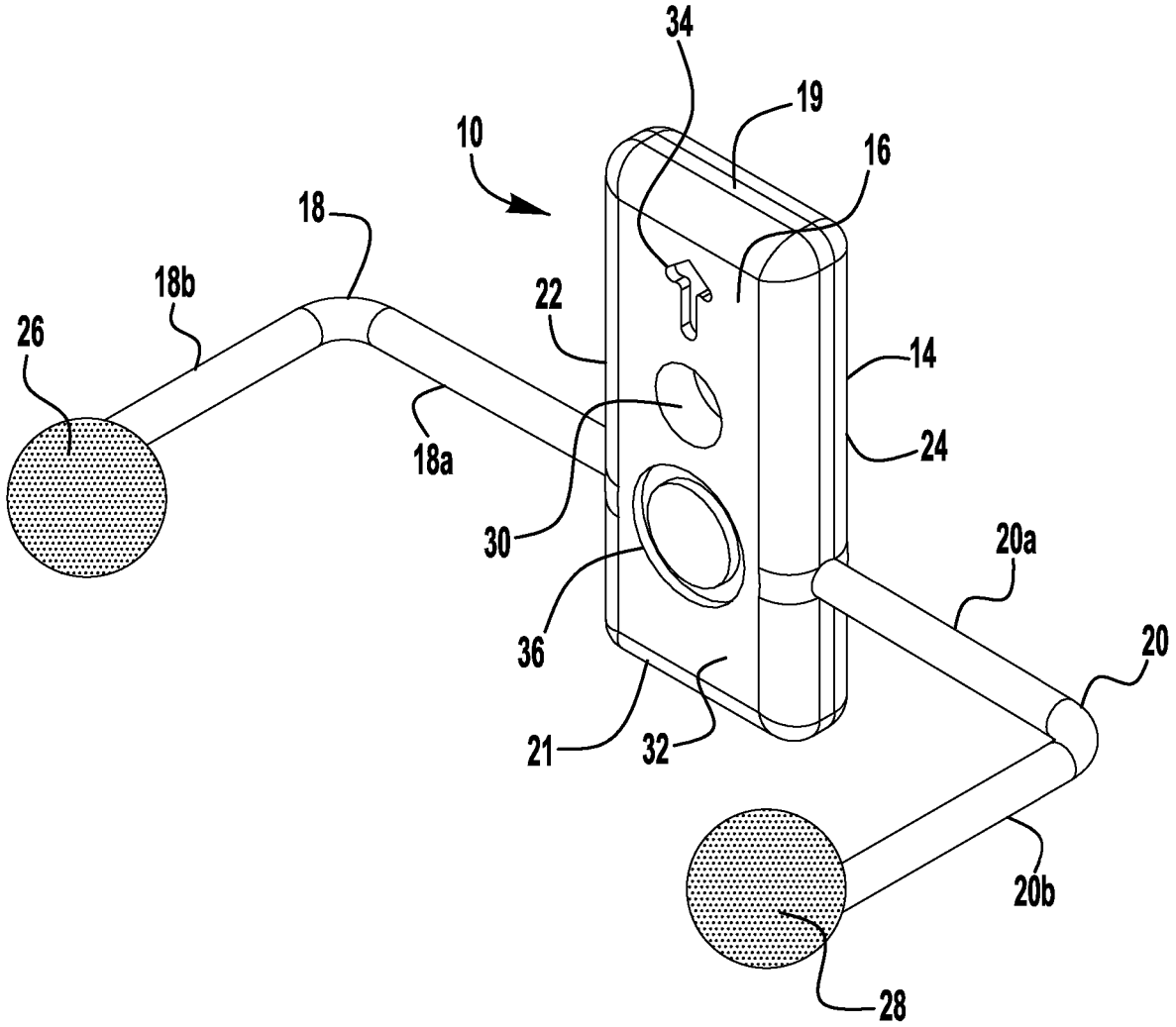
FIG. 1 is a front, three dimensional view of the improved shoe holder, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

The improved shoe holder 10 is designed as a shoe 12 storage and display, and more specifically to a device and method to allow easy storage, access, organization and display of shoes in a vertical disposition so that they can be easily viewed, removed, and returned or replaced. The improved shoe holder 10 provides an improved mode of storing shoes and of displaying shoes. Functionally, the shoe holder 10 is an efficient, easy to manufacture mechanism, which can be easily removed from the wall during periods of non-use.

The improved shoe holder 10 is an effective and novel advice to retain footwear in matched or mated pairs, or alternatively, as one shoe suspended. The shoe holder 10 provides both a storage and display for shoes assembled by the user through which a user can sort or arrange shoes based on individual use and preference. In the present invention, each individual shoe holder 10 can be individually selected, arranged and directly applied to a wall surface by the user.

As illustrated in FIG. 1, the improved shoe holder 10 is comprised of a frame 14 formed of an upright plate 16. First and second support arms 18 and 20 are disposed on first and second side walls 22 and 24 of the upright plate 16. First and second of footwear receiving elements 26 and 28 are mounted respectively on the first and second support arms 18 and 20. Each improved shoe holder 10 is adapted to receive and store one shoe 12. Thus, the improved shoe holder 10 is generally utilized in a pair, to support a pair of shoes 12. However, the improved shoe holders 10, when used in a pair, are identical. It must be noted that the shoes may be of a variety of types, such as sneakers, dress shoes, boots, or any other appropriate footwear, in a variety of sizes.

The improved shoe holder 10 may have any desired shape. A rectangular plate 16 is illustrated having top and bottom walls 19 and 21 respectively, and first and second side walls 22 and 24. However, any desired and appropriate shape may be utilized, such as a circular, oval, triangular, etc. Further, any desired dimensions may be utilized for the rectangular plate 16. As illustrated, the plate 16 has a height with a range between 4 inches and 12 inches, and a width with a range between 2 inches and 10 inches, although any desired dimensions may be utilized. Preferably, the rectangular plate 16 is a one piece, unitary member molded from an economical, recyclable plastic material. However, it is within the terms of the embodiment that any desired material may be used in the construction of the shoe holder 10.

As illustrated, the plate 16 of the improved shoe holder 10 has an opening 30 disposed through the face 32 of the plate 16. The opening 30 is provided to allow the user to mount the shoe holder 10 to the wall with a nail, screw, or any other connecting device, such that the connecting device is inserted through the opening. Alternatively, the improved shoe holder 10 may be mounted to the wall using alternate methods, such as an adhesive or double-sided tape that is simultaneously attached to the rear of the plate 16 and the wall.

It is within the terms of the embodiment that the face 32 of the plate 16 comprises an information element, preferably a bar code that contains information in relation to the shoe 12, which is secured within the shoe holder 10. Further, although optional, as illustrated there is an arrow 34 displayed on the face 32 to clearly display the correct manner to hang the shoe holder 10. Further, there is an optional "L" or "R" within a display 36 to allow the user to know whether the shoe holder 10 is designed for the Left or Right shoe 12.

Figure 2:
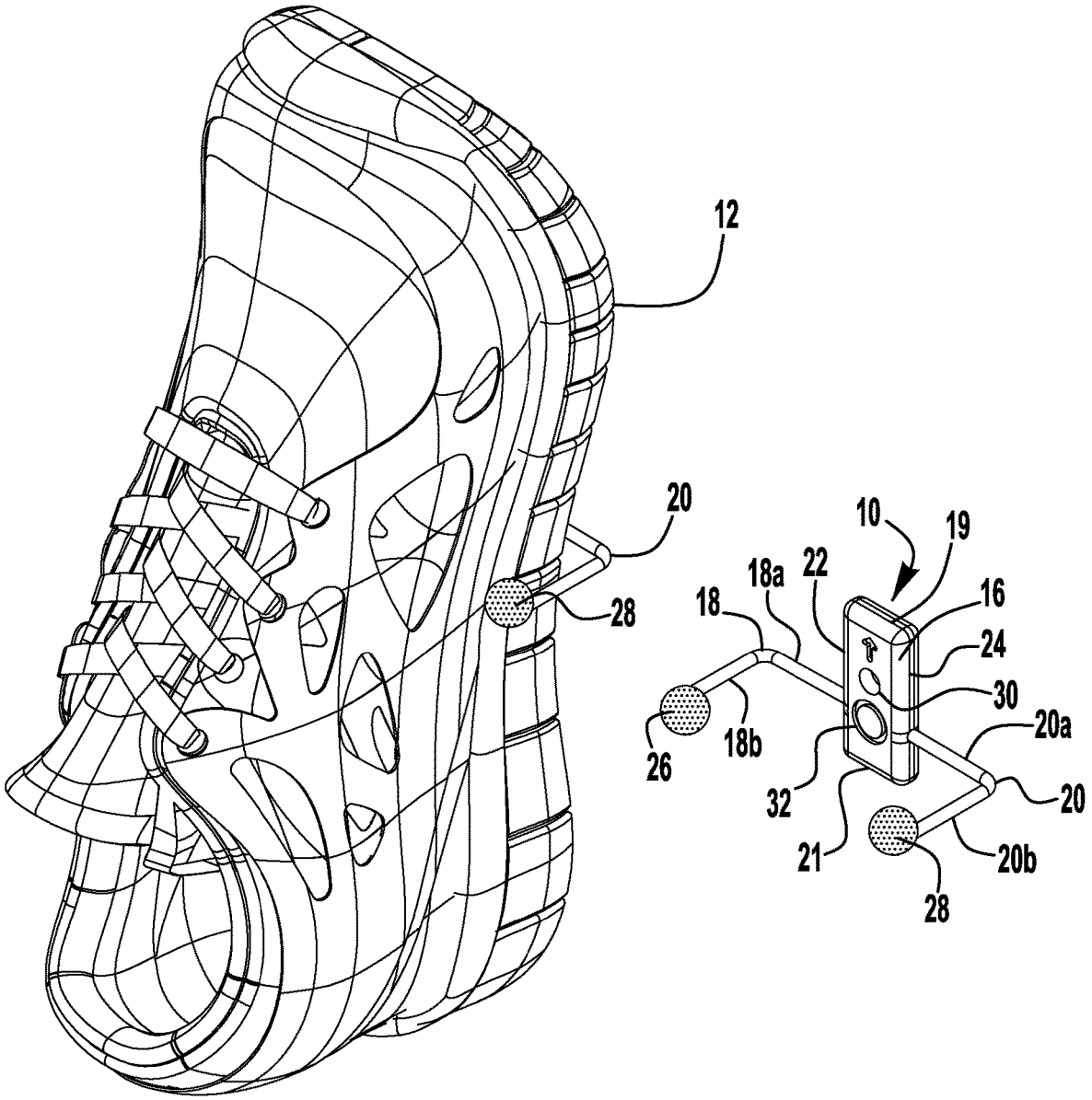
FIG. 2 is a front, three dimensional view of a pair of improved shoe holders in use on a wall, with a shoe in one of the improved shoe holders, in accordance with the present invention.

Each of the support arms 18 and 20 are disposed on first and second side walls 22 and 24, respectively, of the upright plate 16. First and second of footwear receiving elements 26 and 28 are mounted respectively on the first and second support arms 18 and 20. The first and second support arms 18 and 20, as illustrated in FIGS. 1 and 2, are actually identical and simple reversely mounted on the plate 16.

The support arms 18 and 20 are each L-shaped. First support arm 18 is formed of first elongated element 18*a*, which is attached at one end to the side wall 22 and at a second end to a first end of second elongated element 18*b*. The second end of the second elongated element 18*b* is attached to the first footwear receiving element 26.

Second support arm 20 is formed of first elongated element 20*a*, which is attached at one end to the side wall 24 and at a second end to a first end of a second elongated element 20*b*. The second end of the second elongated element 20*b* is attached to the second footwear receiving element 28.

Generally, the first elongated element 18*a* is disposed at approximately a 90 degree angle to the second elongated element 18*b*, and the second elongated element 20*a* is disposed at approximately a 90 degree angle to the second elongated element 20*b*. However, any desired and appropriate angle may be utilized. The first and second support arms 18 and 20 are generally placed approximately ⅓ of the distance from the bottom wall 21 to the top wall 19 of the plate 16.

Each of the first and second footwear receiving elements 26 and 28 are generally ball shaped, although any appropriate shape may be utilized. The first and second footwear receiving elements 26 and 28 may have a coating, such as rubber, to increase the gripping ability of the receiving elements. As illustrated in FIG. 2, a shoe 12 is placed in one of the pair of shoe holders 10. The shoe 12 is placed with the sole directly against the face 32 of the plate 16. The first and second support arms 18 and 20 are designed to extend about the shoe 12 and held in place with the first and second footwear receiving elements 26 and 28.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A shoe holder configured to store and display a shoe in a vertical disposition, comprising:

a frame formed of a rectangular upright plate, the plate has an opening disposed therethrough, and the opening is configured to receive a fastener to mount the shoe holder on a wall;

the frame is a one piece, unitary member having top and bottom walls and first and second side walls;

first and second support arms disposed on the first and second side walls, respectively, of the upright plate, the first and second support arms are L-shaped and located approximately ⅓ of the distance from the bottom wall to the top wall of the plate;

the first support arm is formed of a first elongated rod element and a second elongated rod element, and the second support arm is formed of a first elongated rod element and a second elongated rod element;

the first elongated rod element of the first support arm is attached at one end to the first side wall of the plate, and at a second end attached to a first end of the second elongated rod element of the first support arm;

the first elongated rod element of the first support arm is disposed at approximately a 90 degree angle to the second elongated rod element of the first support arm;

the first elongated rod element of the second support arm is attached at one end to the second side wall of the plate, and at a second end attached to a first end of the second elongated rod element of the second support arm;

the first elongated rod element of the second support arm is disposed at approximately a 90 degree angle to the second elongated rod element of the second support arm; and first and second footwear receiving elements mounted respectively on distal second ends of the second elongated rod elements of the first and second support arms, the first and second footwear receiving elements are spherical shaped with a rubber coating to increase the gripping ability of the receiving elements;

wherein the first and second support arms are configured to extend around the shoe, wherein the first and second footwear receiving elements are configured to hold the shoe in place.

2. The shoe holder of claim 1, wherein the frame is molded from an economical, recyclable plastic material.

3. The shoe holder of claim 1, wherein a face of the plate comprises an information element, that is configured to contain information in relation to the shoe held within the shoe holder.

4. The shoe holder of claim 3, wherein the information element includes an arrow to clearly display the correct manner to hang the shoe holder on the wall.

5. The shoe holder of claim 3, wherein the information element includes an "L" or "R" displayed thereon to allow the user to know whether the shoe holder is designed for a Left or a Right shoe.

* * * * *